United States Patent [19]

Dallimer et al.

[11] Patent Number: 4,744,698

[45] Date of Patent: May 17, 1988

[54] METHOD AND APPARATUS FOR INSTALLING MARINE SILOS

[76] Inventors: Davis S. Dallimer, 20 Brunswick Court, Regency Street, London, JK SWIP 4AE, England; Giles M. B. Nixon, Suite 901, 135, George Street South, Toronto, Ontario, Canada, M5A 4E8

[21] Appl. No.: 948,057

[22] Filed: Dec. 31, 1986

[51] Int. Cl.[4] ..... E02D 7/28; E02D 27/52

[52] U.S. Cl. ..... 405/226; 405/195; 405/198; 405/204; 405/224

[58] Field of Search ..... 405/195, 196, 198, 202–209, 405/224–228, 232; 114/296, 295, 294, 297

[56] References Cited

U.S. PATENT DOCUMENTS

| | | | |
|---|---|---|---|
| 1,221,068 | 4/1917 | McBean | 405/226 X |
| 1,960,080 | 5/1934 | Chapman | 405/226 X |
| 3,263,641 | 8/1966 | Stimson . | |
| 3,354,659 | 11/1967 | Lehmann | 405/226 X |
| 3,412,563 | 11/1968 | Sharp | 405/226 |
| 3,686,877 | 8/1972 | Bodin | 405/224 X |
| 4,007,598 | 2/1977 | Tax | 405/207 X |
| 4,124,989 | 11/1978 | Watson et al. | 405/226 X |
| 4,216,834 | 8/1980 | Wardlaw | 405/224 X |
| 4,255,068 | 3/1981 | Valantin | 405/195 |
| 4,257,721 | 3/1981 | Haynes | 405/224 X |
| 4,318,641 | 3/1982 | Hogervorst | 405/224 |
| 4,405,261 | 9/1983 | Lawson | 405/224 X |
| 4,575,282 | 3/1986 | Pardue et al. | 405/228 |
| 4,604,001 | 8/1986 | Wetmore | 405/197 X |

*Primary Examiner*—Dennis L. Taylor

*Attorney, Agent, or Firm*—Fulbright & Jaworski

[57] ABSTRACT

A method and apparatus for installing marine silos to a desired depth into the seabed such that the interior of the silos is void of seabed material to a desired depth. A submergable silo positioning template operatively supports a silo and excavation modules during surface transportation to the intended site and is capable while floating and submerged of raising and lowering the silo relative to the template and maintaining vertical alignment of the silo. The submergable excavating module incorporates apparatus for loosening and removing sea bed material within the silo thus permitting the silo and excavating module to descend to a desired depth in the seabed. The template and the excavating module are separated from the silo after silo installation and are reused for other silo installations. During silo installation the influence of hydrostatically stimulated force may be employed to assist forcible insertion of the silo into the soil of the seabed.

19 Claims, 9 Drawing Sheets

METHOD AND APPARATUS FOR INSTALLING MARINE SILOS

FIELD OF THE INVENTION

This invention relates generally to positioning of apparatus such as subsea well heads at a suitable level below the surface of a sea bed for the purpose of protecting the apparatus from marine danger that would otherwise be prevalent in locations above the sea bed. More particularly, the present invention relates to a method and apparatus for installing marine silos to a desired depth into the seabed in such manner as to minize installation costs and provide for a significant number of installations in a relatively short period.

BACKGROUND OF THE INVENTION

The present invention, for the purpose of simplicity, will be discussed herein particularly in relation to installation of subsea silos intended to enable positioning of subsea well heads at a desired level below the seabed surface or mud line to thereby protect the well head from damage. It is not intended however to limit the present invention solely to subsea silos for well head installation, it being obvious that the present invention is functional in any environment where a protective subsea enclosure may be desired for apparatus of any suitable character. The spirit and scope of the present invention therefore extends to installation of particular enclosures other then subsea well head silos and to methods for installation of the same within the spirit and scope hereof.

It has now become a wide spread practice to drill oil producing wells in shallow offshore sea areas. In sea areas where ice bergs are present, danger to subsea equipment is obvious. Aside from the possibilty of showing the seabed during ice berg movement, they also tumble from time to time as the surface portion melts and the center of gravity changes. During such tumbling ice portions can contact the seabed, developing deep scouring. In the Beaufort Sea for example the water is shallow and there is a serious hazard in the form of floating ice which tends to accumulate. This floating ice may develop into ice ridges which not only accumulate above the water but also develop a substantial submerged section referred to as an ice keel.

The ice ridges and ice keels tend to drift responsive to wind and current and as they are driven relative to shallow areas, they may scour the sea floor. Thus, it has become necessary for all companys operating in the Beaufort Sea where sheet ice is present to provide means for protecting the subsea well head equipment including blowout preventors (BOP), well heads, etc. from the risk of ice damage by the scouring effect of moving ice ridges and ice keels. It has been found desirable therefore to locate subsea well heads and BOP stacks beneath the point of the seafloor of known ice ridge scour. In the past the required depth of well head location was achieved by dredging a large area of the seabed to a depth below known iceberg or ice keel scouring (known as a "glory hole") and setting the well head and BOP stack in this depression on the seabed.

The above method is extremely costly and requires the dredging of large quantities of material with a seagoing dredger of high capacity, or operating the dredge head airlift of a dredging ship. A large "clam shell" dredge may also be employed to dig glory holes, but represent considerable expense. An example of a prior system is described in Canadian Pat. No. 995,583 issued Aug. 24, 1976. That system includes a caisson embedded in the seafloor by methods such as driving, jetting or a combination of the two. The upper region of this caisson includes a plurality of horizontally connected circular segments joined by breakaway joints. In this manner, when an upper portion of the caisson is contacted by an icemass, the entire casing is not damaged or deformed, but only a particular segment may be broken away. With regard to generally related methods and apparatus U.S. Pat. Nos. 4,318,641 and 4,432,671 teach hydrostatic sinking of anchors in waterbottoms.

SUMMARY OF THE INVENTION

It is the principle object of the present invention to provide an improved and less expensive system for sinking a silo or caisson in the seabed and excavating seabed material from within the silo to form a protective chamber extending from the seabed to a level safely below the seabed within which may be located a subsea well head or other marine apparatus. It is also a feature of this invention to provide the novel method and apparatus for transporting a silo to its installation site, lowering the silo to a seabed and sinking the silo into the seabed to a designed depth. The invention also includes maintenance of the silo at a vertical position during its installation.

Briefly, the invention concerns the provision of a buoyancy controlled silo installation template which establishes a secure restraining relationship with a silo and maintains that restraining relationship during towing of the template and silo to the intended installation site. An excuation module is disposed within the silo during movement of the apparatus to its intended site. Through adjustment of its buoyancy control, the template is submerged and lowered to the seabed where it establishes firm contact with the seabed for stabilization of the silo. The template is leveled on the seabed by adjusting its supporting legs. Through manipulation of the silo restraining apparatus of the template, the silo, with the excavation module inside, is lowered relative to the template until its lower extremity contacts the seabed and by virtue of its weight, penetrates the seabed to the extent permitted by seabed composition.

The submergable excavation module rests upon a thrust ring which is provided within the silo. The buoyancy system of the excavation module determines the effective weight which is applied by the excavating module to the silo. The excavation module incorporates a buoyance system, which, together with its position adjustment relative to the template, provides for stability control of the template; silo/excavation module both at the sea surface and during descent to the seabed. This buoyaness system also may be employed to develop an upward force on the silo to retard downward silo movement such as in unconsolidated soil. The excavation module includes suitable apparatus such as a cutter suction dredge head system or a water jet array system for loosening seabed material at the bottom of the silo. The loosened seabed material is then transported from the silo, thus permitting the silo and the excavating module to decend into the seabed by virtue of the hole created by the dredging activity. Simultaneously, the template permits controlled downward movement of the silo relative thereto while at the same time maintaining vertical alignment of the silo until installation of the silo to its desired depth has been completed. The excavation module is then withdrawn from the silo and raised to the surface through activation of its buoyancy control. It may be stationed at the surface or it may be loaded onto a service vessel for transportation to shore or to another silo installation site. The submergable template is then disconnected from the silo and, through its buoyancy control, is raised to the surface for transportation to shore or to another silo installation site. While at the surface or while submerged, the template may receive another silo in assembly therewith, the silo being transferred from a service vessel to a restrained relationship with the submergable template.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings, which drawings form a part of this specification.

It is to be noted however, that the appended drawings illustrate only typical embodiments of is invention and are therefore not to be considered limiting of its scope, for the invention may admit to other equally effective embodiments.

IN THE DRAWINGS

Figure 1:
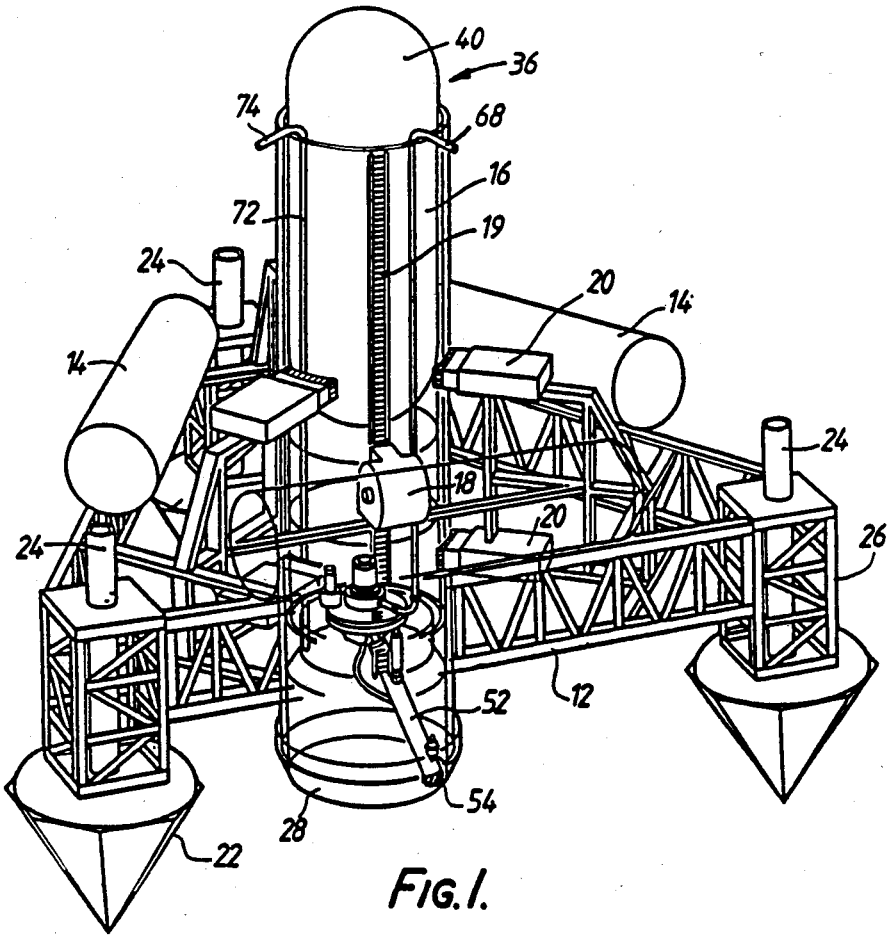

The present invention both as to its organization and manner of operation, together with further objects and advantages thereof, may best be understood by way of illustration and example of certain embodiments when taken into junction with the accompanying drawings in which:

FIG. 1 is an isometric view illustrating the operative assembly of a subsea silo to be installed in the seabed and a submergible silo installation template for installation of the site together with an excavation module in assembly within the silo.

Figure 2:
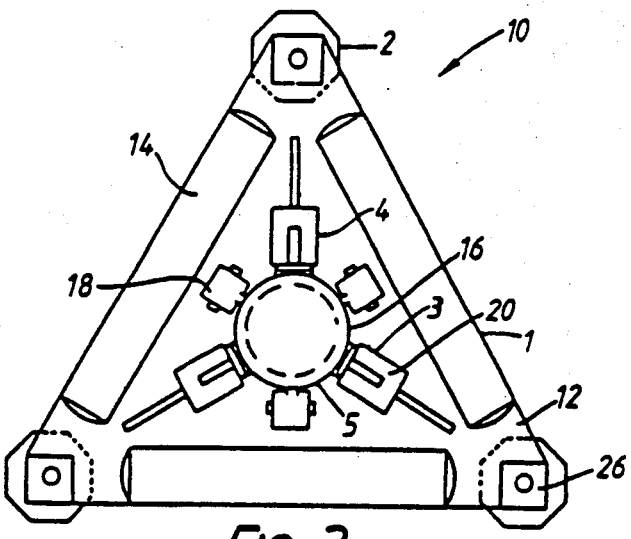

FIG. 2 is a plan view illustrating a submergable silo supporting template and subsea silo and excavation module which are constructed in accordance with the present invention.

Figure 3:
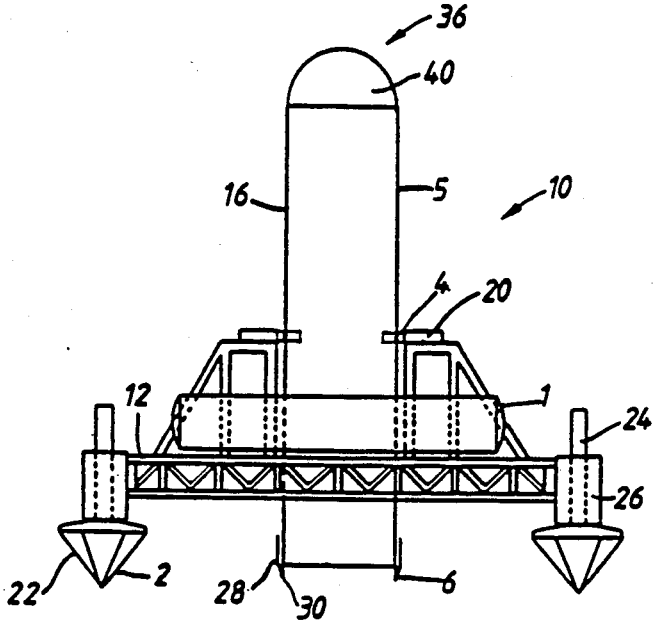

FIG. 3 is an elevational view of the submergable template of FIG. 1 also illustrating a silo and excavation modules in supported assembly therewith.

Figure 4:
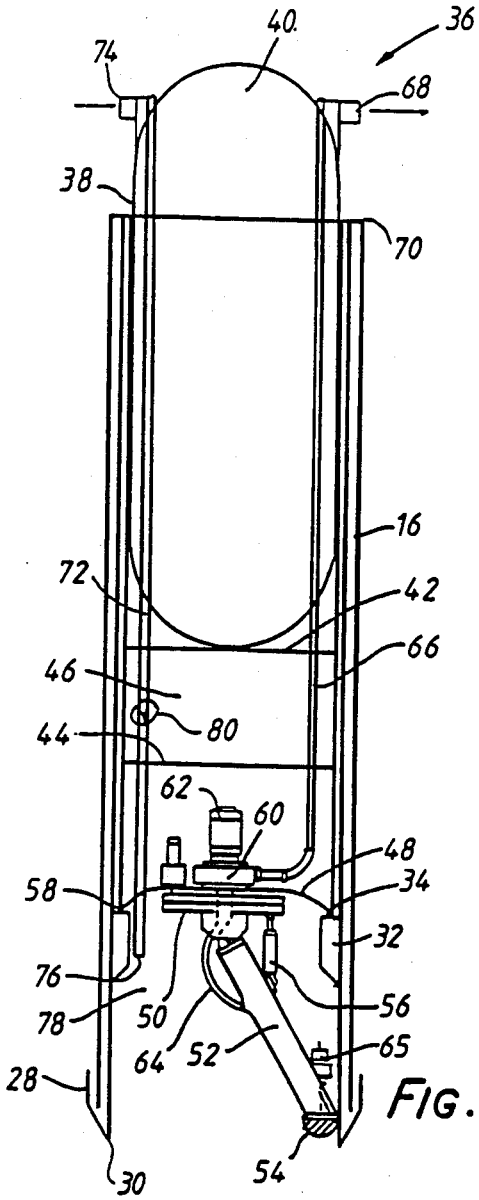

FIG. 4 is a sectional view of a subsea silo, showing an excavation module of this invention positioned therein with a cutter suction dredge head thereof positioned for excavating contact with material of the seabed.

Figure 5:
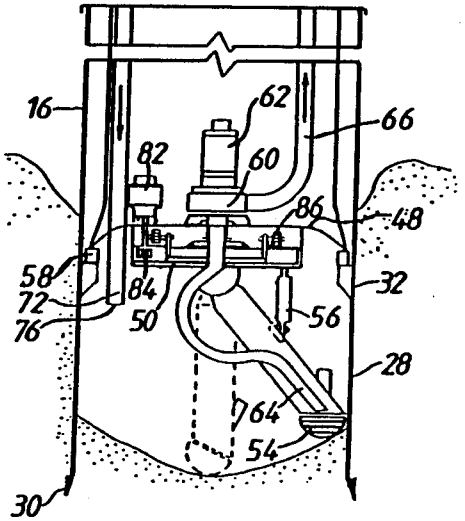

FIG. 5 is a partial sectional view of a subsea silo with an excavation module shown therein with its cutter suction dredge head system in contact with the material of the seabed.

Figure 6:
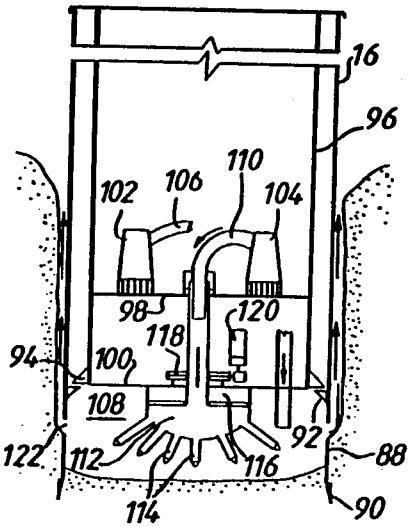

FIG. 6 is a partial sectional view of a subsea silo representing a modified embodiment of this invention and showing an alternative excavation module positioned operatively therein.

Figure 7:
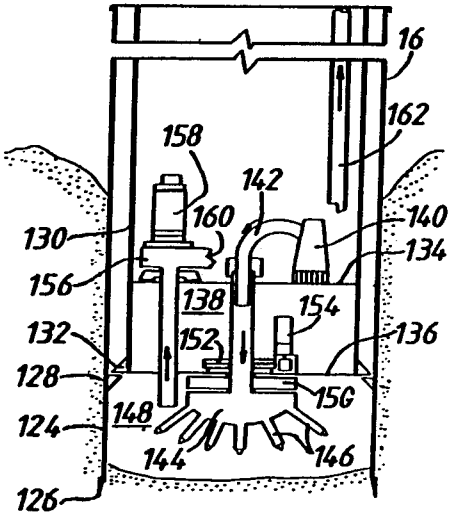

FIG. 7 is also a partial sectional view of a subsea silo representing another embodiment of this invention and showing another type of jet excavation module in operative assembly therein.

Figure 8:
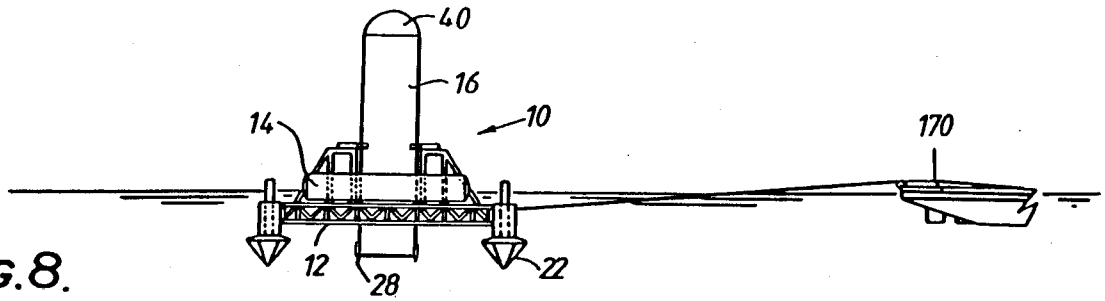

FIG. 8 is a pictorial representation of a submergable template shown stationed at the surface with a silo in raised and restrained assembly therewith and further showing the launching and shallow water towing relation of the template silo and excavation module assembly at the surface.

Figure 9:
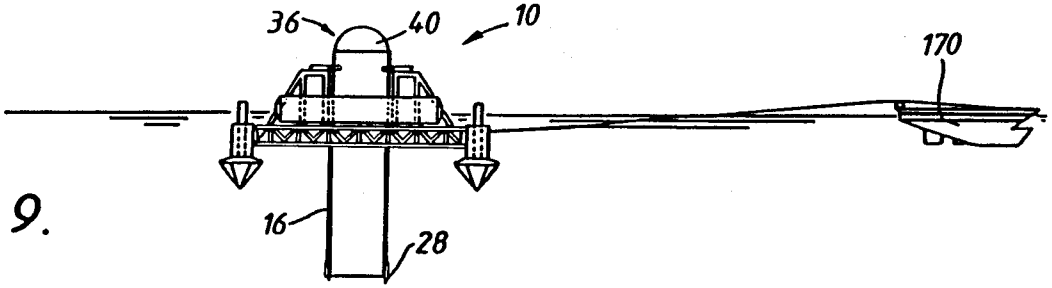

FIG. 9 is a pictorial elevational view similar to that of FIG. 7, illustrating the silo and excavation module being lowered relative to the template for stability during towing in deep water.

Figure 10:
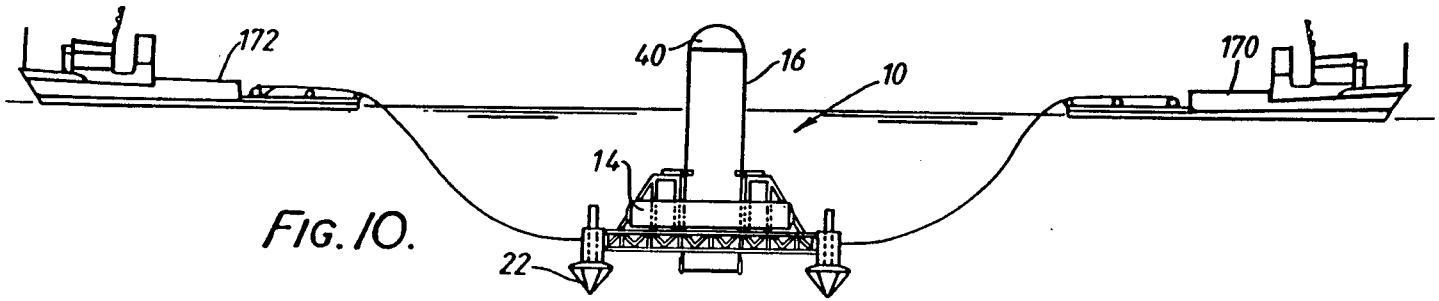

FIG. 10 is another pictorial representation showing the template silo and excavation module being controlled by surface vessels and being lowered toward the seabed.

Figure 11:
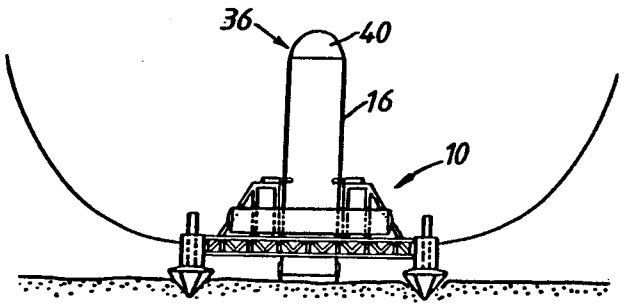

FIG. 11 is a pictorial representation of the template in contact with the seabed and with the lower extremity of the silo at the level of the seabed in readiness for silo installation by the excavation module and template.

Figure 12:
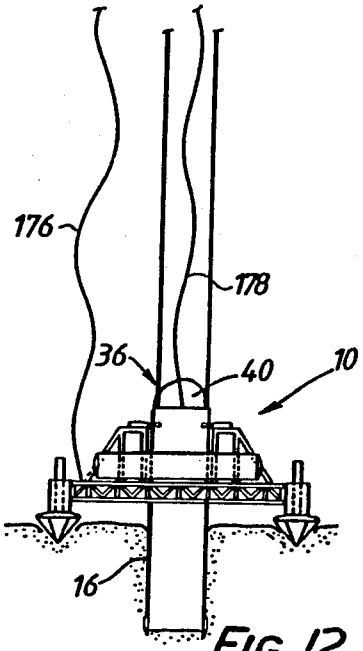

FIG. 12 is a sequential pictorial representation showing lowering of the silo relative to the template during excavation by an excavation module located within the silo together with selective weight control and hydrostatically induced drive.

Figure 13:
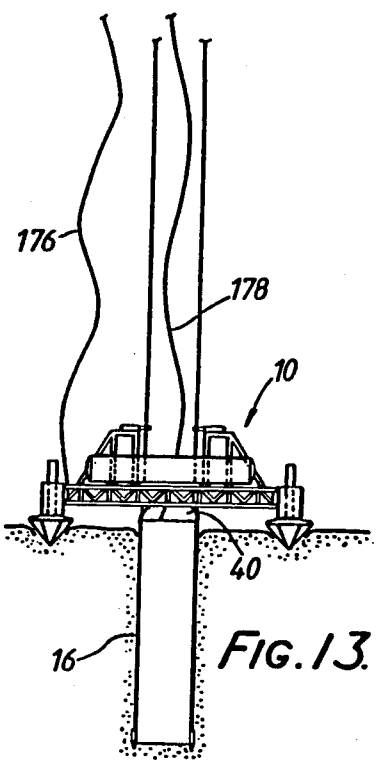

FIG. 13 is a pictorial representation showing the silo of FIG. 12 at its fully inserted position in the seabed.

Figure 14:
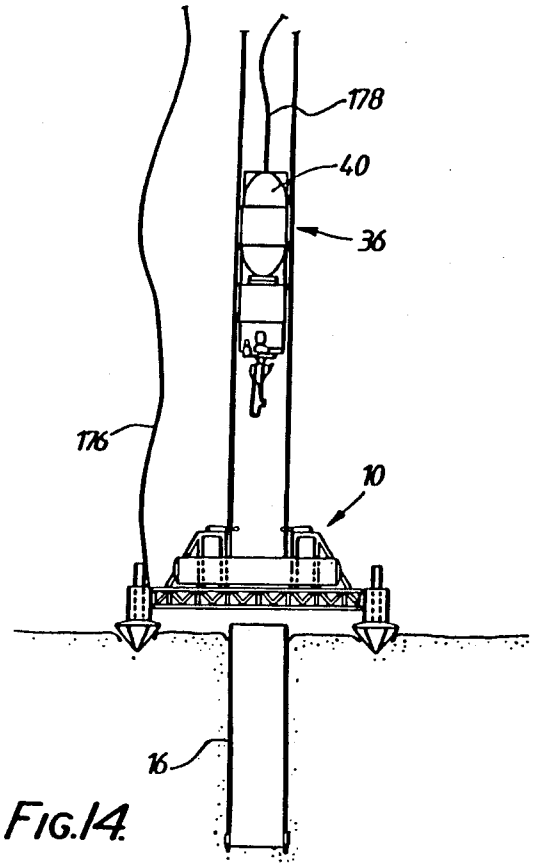

FIG. 14 is a pictorial representation illustrating removal of the excavation module from the inserted silo following completion of silo installation.

Figure 15:
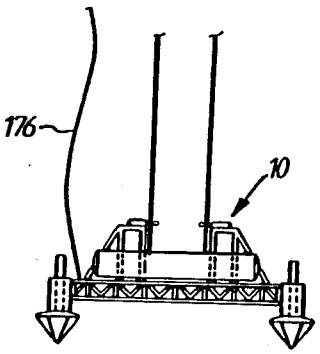
Figure 15:
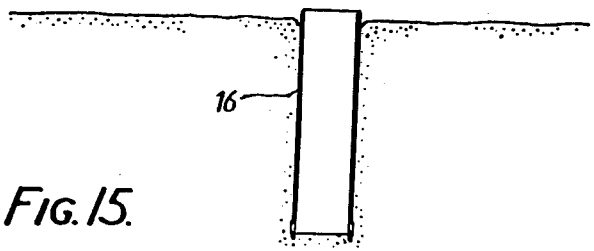

FIG. 15 is a pictorial representation illustrating raising of the submergable template to the surface after installation of the silo has been completed and the excavation modules has been recovered.

Figure 16:
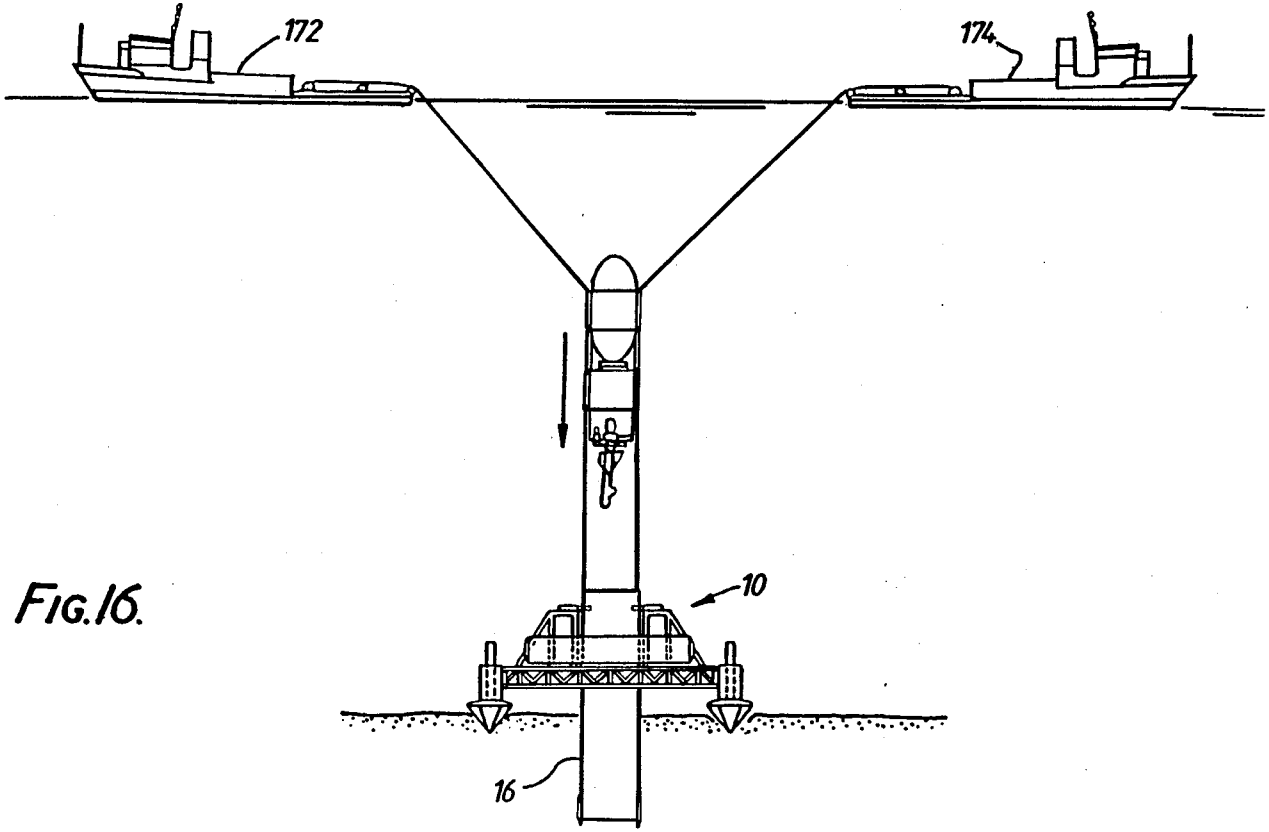

FIG. 16 is an illustration showing insertion of an excavation module into a partically inserted silo such as would occur if the excavation module should require repair during silo installation.

Figure 17:
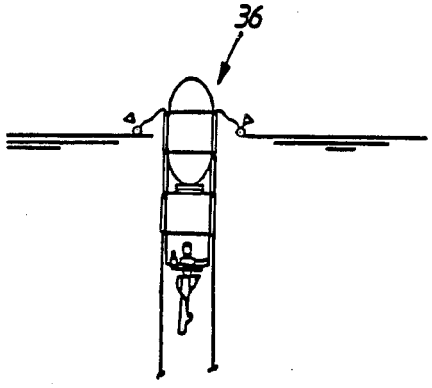

FIG. 17 is a view showing the excavation module floating at the surface and buoyed for recovery.

Figure 18:
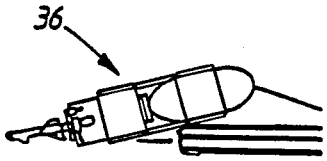

FIG. 18 is a view illustrating loading of the excavating module onto a surface vessel for shipping to port or to another silo installation site or for the purpose of repair.

Figure 19:
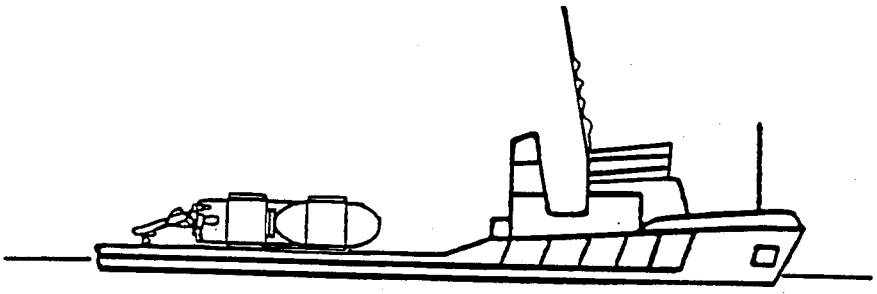

FIG. 19 is a pictorial representation illustrating an excavating module completely loaded on a surface vessel for transportation or for repair.

DESCRIPTION OF THE PREFERRED EMBODIMENT

Refering now to the drawings and first to FIGS. 1, 2 and 3 a submergable template is illustrated generally at 10 which comprises a structural framework 12 having buoyancy tanks 14 mounted thereon for controlling the buoyancy of the template and a silo in restrained assembly therewith. FIGS. 1–3 show a silo at 16 which is secured by holdback gear 18 including plural drive and holdback units which establish restraining and driving engagement with external gear tracks 19 of the silo 16. The drive and holdback gear is capable of raising and lowering the silo relative to the template such as for maintaining stability of the template and silo during transportation and for lowering the silo during its installation into the seabed. The template is also provided with a plurality of vertical alignment rams 20 having position adjusting engagement with the silo and which are appropriately operative to maintain vertical alignment of the silo during its insertion into the seabed. The template 10 also includes a plurality of seabed engaging elements 22 which establish firm contact with the seabed. The seabed engaging elements, also refered to as spud cans, enter the seabed material sufficiently to maintain stability and orientation of the template at the seabed. Each of the seabed engaging elements is mounted at the lower end of a vertical support element 24 which is operatively received by a position adjustment mechanism 26. The position adjustment mechanism is hydraulically energized or may be energized by any suitable mechanism capable of adjusting the position of the template/silo/excavation module assembly at the seabed. Thus, by operating the adjustment mechanism 26, the seabed contacting elements 22 may be adjusted relative to the template so as to provide for coarse position adjustment of the template and silo. Fine adjustment of the vertical condition of the silo is then accomplished by means of the vertical alignment rams 20.

The silo 16 is generally in the form of an elongated tubular element having a cutting shoe 28 at its lower extremity defining a circular cutting edge 30. As the silo is lowered relative to the seabed the cutting edge 30 slices through the seabed material until the resistence of the material provides support for the silo. As the seabed material is removed from within the silo the cutting edge 30 continues to descend until such time as the upper portion of the silo is properly located with respect to the mud line established by the seabed. Descent of the silo into the seabed formation is controlled by the template and by an excavation module in the manner described below.

With reference now to FIG. 4 the silo structure 16 is illustrated in greater detail. Within the cutting shoe of the silo is located a thrust ring 32 defining a circular, upwardly facing support shoulder 34.

A drilling or excavation module is provided as shown generally at 36 which is in the form of a elongated, compartmented structure defined by a body 38 having a buoyancy chamber 40 secured at the upper portion thereof. Below the buoyancy chamber is provided a transverse bulkhead 42 cooperating with another transverse bulkhead 44 so as to define a machinery compartment 46 within which is located various power equipment for energizing the excavating module and for controlling the buoyancy chamber. At the lower portion of the housing 38 is provided another transverse bulkhead 48 which is of domed configuration and provides structural support for a slew ring 50 having a dredge arm 52 and cutting head 54 rotatably supportive thereby. Positioning of the dredging arm 52 is controlled by a dredge actuator 56 which may be hydraulically energized.

The lower portion of the excavation module defines a support rim 58 which is adapted to seat against the shoulder 34 of the thrust ring 32. At the lower portion of the excavating module the domed transverse bulk head 48 also provides structural support for a pump 60 which is energized by a suitable motor 62. The pump 60 has its suction line 64 extending through the dredge arm 52 to the vacinity of the cutting head 54 so that dredge cutting may be pumped along with water from the vacinity of the cutting head. The cutting head is rotably driven by a motor 65 which may be energized hydraulically or by any other suitable source. A discharge line 66 from the pump 60 extends upwardly to a level above the upper extremity 68 of the silo to a gravel discharge 68. Dredge cuttings, gravel, silt and like are pumped upwardly through the discharge line 66 and are discharged into the surrounding seawater above the level of the silo. For introduction of seawater into the cutting area below the transverse bulkhead 48, a water supply line 72 is provided which extends through the transverse bulkheads 42, 44 and 48 and terminates within the excavation compartment 78 below the transverse bulkhead 48. The upper extremity of the supply line 72 defines a water intake 74 which is so located relative to the discharge 68 that water, free of drill cuttings and other contaminates flow into the excavation compartment replacing contaminated water pumped therefrom.

The excavating module establishes an efficient seal at its supported relationship against the upwardly facing circular shoulder 34 of the thrust ring 32. In the event additional downwardly force is desired to enhance penetration of the cutting edge of the cutting shoe into the seabed formation hydrostatically induced force may be utilized to enhance the forces attributed by the weight of the silo and the weight of the excavation module. Further, the excavation module with its buoyancy system may be controlled to develop an upward force on the silo to retard downward silo movement such is in unconsolidated soil. By controlling introduction of water through water supply line 72 into the excavation chamber below the transverse bulkhead 48 a reduced pressure condition may be developed within the excavation chamber by virtue of pump operation. By controlling water supply in supply line 72 by means of a control valve 80 a differential pressure condition may be developed causing a hydrostatic pressure differential to exist, thereby developing a downwardly directed resultant force on the excavation module, which force is transmitted through the thrust ring to the lower portion of the silo. Thus by simply varying the water supply to the excavation chamber concurrently with activation of the discharge pump, the pressure would then be reduced in the excavation chamber and the pressure differential acting upon the excavating module and silo may be adjusted to provide the magnitude of downwardly directed force that is required for efficient silo installation. Further, through variation of the buoyancy of the buoyancy chamber the effective downwardly directed force of the excavation module may be varied. The hydrostatically induced downwardly directed force may therefore be controlled in its magnitude or it may be varied in cyclical manner to influence penetration of the silo into the seabed. The silo installation may be maintained at zero buoyancy or may be positively or negatively buoyed as appropriate for efficient silo insertion domed bulkhead 48 also provides support for a pump 60 which is driven by motor 62. A pump suction line 64 of the pump 60 is communicated through the dredge arm 52 with the cutting head portion 54. Thus, the pump 60 is capable of removing water, and loosened seabed material from the immediate vacinity of the suction cutting head 54. A discharge line 66 extends upwardly from the pump 60 and terminates at a gravel pump discharge 68 disposed above the upper extremity 70 of the silo. The excavation module also includes a water supply line 72 having a water intake 74 at its upper extremity. The lower end 76 of the water supply line is disposed below the level of the domed transverse bulkhead 48, thus allowing incoming water to flow into the excavation chamber 78 formed cooperatively by the silo and the transverse bulkhead 48. The water supply line 72 may also be provided with a control valve 80 which may be adjusted to control inlet of water into the excavation chamber 78. With the dredged suction pump 60 operating to develop normal suction pressure, the valve 80 may be closed or partially closed as desired to control the magnitude of hydrostatically induced force acting downwardly upon the silo structure. The peripheral portion of the domed bulkhead 48 forms a seal with the upwardly facing shoulder 34 of the thrust ring. By lowering water pressure in the chamber 78 below the bulkhead 48 a pressure differential will exist across the domed bulkhead. Thus, pressure differential determined by the hydrostatic pressure acting upon the upper surface of the bulkhead and the pressure within the chamber 78 will determine the magnitude of the hydrostatically induced force acting downwardly upon the silo. By effectively controlling the valve 80 or by controlling suction of the pump 60 the hydrostatically induced downward drive may be varied between zero and the maximum hydrostatic drive available at water depth. For example with a silo of 20 meters in height and a diameter of 5 meters and with a water depth of 100 meters the maximum hydrostatic drive will be in the order of 1250 tons. Obviously, with water of different depths, the maximum hydrostatic drive will be of different magnitude. It will also be determined that soil condition influence hydrostatic drive. With loose soil conditions, such is typically formed as at or near the surface of the seabed, the available hydrostatic drive will be less than with more compact soil conditions several feet below the surface of the seabed. Also, as the silo and excavation module desend, available hydrostatic force will increase due to increasing water depth above the level of the domed bulkhead 48.

As indicated in FIG. 1 the silo structure will be provided with a plurality, preferably three of elongated ladder, rask or gear like members 19 enabling a like number of holdback units 18 of the template to engage and provide restraing support for the silo. The holdback units 18 are capable of providing a supporting or restraining function as desired to support the silo in substantially immobile relation with respect to the template and also provide a driving function to raise or lower the silo relative to the template, such as for stability of the template and silo assembly at the surface and for controlling insertion of the silo into the seabed.

FIG. 5 of the drawings discloses a cutter suction dredge head system in combination with an excavation module the structure being similar to that disclosed in FIG. 4. The slew ring 50 may be rotated by a hydraulic motor 82 and the motor 62 driving the dredge pump 60 may also be a hydraulic motor if desired. The dredge head actuator 56 may be hydraulically energized for imparting controlling movement to the cutter suction dredge head as it is rotated by the slew ring causing the cutter element 54 thereof to sweep all of the surface area of the seabed located within the confines of the cutting shoe 28. During sweeping of the cutter head 54 the cutter head will be rotated against the seabed soil thereby loosening the soil. This loosened soil, combined with water, will be removed from the silo by the suction line 64 of the pump 60 and will be ejected from the silo via the discharge line 66 of the pump. For rotation of the cutter portion of the dredge head the hydraulic motor 82 is energized, thereby driving a gear system incorporating drive and driven gears 84 and 86 to achieve rotation of the slew ring 50. Thus, by virtue of the rotating slew ring and the pivotal articulating movement of the dredge head the seabed material exposed within the silo will be effectively loosened and removed.

Refering now to FIG. 6 it is evident that the excavation module may be provided with a water jet array system wherein soil loosening and removal may be accomplished by jetting activity without the use of a rotary dredge head. Further, ejection of seabed material from the excavation chamber near the cutting shoe of the silo is achieved at the lower extremity of the silo rather then at the upper extremity as discussed above in connection with FIGS. 1–5. The silo 16 includes a cutting shoe 88 having a lower cutting edge 90 which enables the silo to slice through the formation as it extends into the seabed. The cutting shoe 88 defines an internal thrust ring 92 which provides for seating of the lower sealing and seating peripheral portion 94 of an excavation module 96. The excavation module includes transverse bulkheads 98 and 100 with bulkhead 98 providing support for a pair of jet pumps 102 and 104. The discharge line 106 of pump 102 extends through bulkheads 98 and 100 and terminates within the excavation chamber 108. The discharge line 110 of pump 104 is in communication with a jet head 112 having disposed thereon a plurality of water jets 114 which are oriented to cause loosening of the seabed material. The head 112 is rotatably mounted on a support plate and bearing system 116 and is rotated by means of a rotary drive mechanism 118 energized by a hydraulic drive motor 120. Thus, the water jet head 112 is rotatable within the excavation chamber 108, causing revolving of the jet members 114 to cause loosening of the formation by water jetting activity. Outflow of water and loosened soil from the excavation chamber 108 occurs by virtue of a plurality of outlet openings 122 formed in the cutting shoe 88. These outlet openings define upwardly directed passages which direct the outflow from the chamber 108 upwardly along the outer wall surface of the silo 16. Thus, loosened soil from the excavation chamber is carried along with the outflow of water upwardly to the surface of the seabed where it spreads outwardly or is carried away from the site by water current. The water outflow also maintains the silo substantially clear of soil which might otherwise retard downward movement of the silo into the seabed. It should be noted that the embodiment of FIG. 6 is not capable of employing hydrostatic drive to enhance silo insertion.

Refering now to FIG. 7, another embodiment of the present invention is disclosed wherein a silo 16 is provided having a cutting shoe 124 defining a lower cutting edge 126 and an inwardly directed thrust ring 128. An excavation module 130 is provided having a lower support ring 132 establishing force transmitting sealed relationship with respect to the thrust ring of the silo. The excavation module 130 defines transverse bulkheads 134 and 136 defining a machinery compartment 138. A jet pump 140 is provided which is supported by bulkhead 134 and is positioned with its discharge line 142 in communication with a rotary jet nozzle array 144 having plural jets 146 for loosening and dispersing seabed material in the excavation chamber 148. The jet nozzle array is supported by a bearing plate 150 which is rotatably mounted on bulkhead 136. The jet nozzle array is rotatably driven by a rotary drive mechanism 152 powered by a hydraulic drive motor 154.

For discharge of water and soil from the excavation chamber 148 a dredge pump is provided as shown at 156 which is energized by a hydraulic motor 158. The discharge 160 of pump 156 is in communication with a soil ejection pipe 162 which functions to transport soil and water upwardly to a level above the upper extremity of the silo for discharge into the surrounding water in the manner shown in FIG. 4.

Downwardly directed hydrostatic drive may be achieved in the systems shown in FIGS. 5 and 7 such as by varying the pumping velocity or controllably varying the supply of water into the excavation chamber. In each case, the excavation module forms a seal with the thrust ring portion of the cutting shoe. By varying inflow and outflow of water from the excavation chamber of the embodiments shown in FIGS. 5 and 7 and controlling pressure differential across the sealed bulkhead, this pressure differential may be efficiently controlled to develop a downwardly directed hydrostatic pressure induced force varying from zero to many tons. Moreover, the hydrostatically directed force may be induced cyclically in order to assist in downward movement of the silo into the soil depending upon the soil conditions encountered or silo insertion movement may be retarded by the buoyancy control of the excavation module.

Refering now to FIG. 8 the template system 10 is shown in its floating condition with buoyancy being provided by the flotation tanks 14. The silo 16 is shown in its raised position such as during launching or for towing in shallow water conditions. The template and silo assembly may be towed such as by a towing vessel 170 to a suitable location for a silo installation. It should be born in mind that the system is fairly unstable in the condition of FIG. 8.

As shown in FIG. 9 the silo installation system is shown with the silo 16 and its excavation module lowered relative to the template 10 such as for stability while being towed in deep water conditions or water conditions involving heavy seas. Refering to FIG. 10, the template 10 is shown tethered by service vessels 172 and 174 while the buoyancy of the template/silo/excavation module system is reduced by appropriate control of the flotation tanks 14. With the silo 16 in its raised position relative to the template, the system is lowered into contact with the sea floor as shown in FIG. 11. The spud cans 22 become partially embedded into the sea floor to establish appropriate stabilized support for the silo and template. Coarse vertical alignment or leveling of the template is then achieved by controllably adjusting the spud cans relative to the template so as to achieve nearly vertical positioning of the silo 16. At this point silo installation can begin through controlled energization and buoyancy control of the template and excavation module.

In FIG. 12, which is a sequential illustration during silo insertion, the silo installation template is shown with the silo 16 partially inserted into the seabed. Both the template and the excavation module are provided with appropriate control umbilicles 176 and 178 permitting adjustment or leveling of the template relative to the seabed and permitting adjustment the silo relative to the template so as to render it vertical. The control umbilicles 176 and 178 of the template and excavation module permits their control from a surface vessel. As shown in FIG. 12 the silo 16 has penetrated the seabed formation substantially half its length being maintained vertically by means of the position adjustment rams of the template. As shown in FIG. 13 the silo 16 is fully installed into the seabed formation and the excavation module is ready for removal from the silo.

In the sequential view of FIG. 14 the silo installation template 10 is shown grounded to the seabed with the silo 16 being fully inserted into the seabed formation. The excavation module 36 is shown after extraction from the silo and during its ascent to the surface by control of its flotation vessel 40. It is raised and lowered by controlling the buoyancy thereof. The installation cables merely serve as guides to insure its positioning relative to the silo and its controlled guidance to the surface after extration from the silo. After the excavation module has been recovered, the template 10 is ready for its ascent to the surface. With its flotation tanks appropriately adjusted, the assend to the surface where it floats until further activities are desired. Another silo may be transferred from a surface vessel and brought into assembly with the template, thus restoring it to the condition as shown in FIG. 8 or FIG. 9 except for the presence of the excavation modules. As an alternative, mating of the silo and excavation modules to the template may be accomplished underwater if desired. It is envisioned that a silo may be installed in one days time with actual injection of the silo into the seafloor being accomplished in only a few hours time. The expense of installation is significantly reduced in comparision with "glory hole" location of well heads relative to the mud line at the seabed.

Referring to FIG. 16 the template is shown grounded to the seabed with the silo partially inserted. In the event repair of the excavation module 36 is required it may be withdrawn from the silo and recovered such as through a guidance of service vessels 172 and 174 and guide cables 173 and 175. The module 36 is caused to ascend to the surface by its buoyancy control system and, after repair is caused to descend to silo level by its buoyancy control, being guided into the silo by the guide cables.

FIGS. 17, 18 and 19 illustrate recovery of the excavation module 36 such as for repair or transport. As shown in FIG. 17 the excavation module is buoyed at the surface of the sea in readiness for its further activities. It may be towed to a nearby site or, if the site is at a significantly remote location or it is intended that the excavation module be transported to port, it may be loaded in the manner shown in FIG. 18 onto a service vessel in the manner shown in FIG. 19.

We have provided a novel method and apparatus for installation of subsea silos which permits rapid, low cost installation of protective chambers for equipment intended for location near the mudline of the ocean floor. Through the use of silos, expensive equipment such as wellheads may be safely located out of danger such as by collision by various marine objects or ice which might otherwise cause severe damage thereto. This invention is therefore well adapted to attain all of the objects and features set forth hereinabove together with other objects and features that are inherent in the description of the silo installation apparatus itself. It will be understood that certain combinations and subcombinations are of utility and may be employed without reference to other features and subcombinations. This is contemplated by and is in the scope of the present invention.

As many possible embodiments may be made at this invention without departing from the spirit or scope thereof, it is to be understood that all matters hereinabove set forth or shown in the accompanying drawings are to be interperted as illustrative and not in any limiting sense.

We claim:

1. Apparatus for installing marine silos to a desired depth into the seabed such that the interior of the silos is void of seabed material to a desired depth, said apparatus comprising:

(a) a submergible silo positioning template operatively supporting said silo during surface transportation of the silo to its intended site; and being capable while floating and submerged of raising and lowering said silo relative thereto, said silo positioning template including means for maintaining vertical alignment of said silo during installation thereof.

(b) a submergible excavation module capable of establishing mated assembly with the silo with at least a portion thereof entering the silo; and (c) excavation means being operatively supported by said excavation module and being controllably movable relative to said excavation module and the silo, said excavation means being capable of loosening the soil of the seabed and removing the loosened soil from the silo.

2. Apparatus as recited in claim 1 wherein said silo positioning template comprises:

(a) a structural framework;

(b) a plurality of seabed engaging elements extending from said structural framework and adapted to establish secure engagement with said seabed for stationing said structural framework relative to the seabed;

(c) means for controllably adjusting said seabed engaging elements relative to said structural framework for controlling positioning of said structural framework and thus vertical alignment of the silo; and (d) buoyancy controlling means being provided on said structural framework and selectively controlling the buoyancy of said silo positioning template and a silo when in supported assembly therewith.

3. Apparatus as recited in claim 2 wherein said template further includes:

(a) a plurality of holddown mechanisms for establishing restraining engagement with the outer portion of a silo:

(b) means selectively actuating said holddown mechanisms to induce vertical controlled movement of the silo relative to said silo positioning template;

(c) silo positioning means for positioning engagement with the outer portion of a silo and being controllably operative a silo relative to said template; and (d) means for energizing said silo elevating means.

4. Apparatus as recited in claim 3 wherein a plurality of restraining means are provided on the external portion of said silo, said holddown mechanisms establishing driving and restraining engagement with said restraining means.

5. Apparatus as recited in claim 4, wherein said restraining means are in the form of elongated rack ladder means, each being engaged by said holddown means.

6. Apparatus as recited in claim 1 wherein said excavation module includes:

(a) elongated body means adapted to enter said silo and become intimately connected therewith so as to selectively transmit downward and upward forces to the silo;

(b) means establishing a substantial seal within said silo, said silo and said body forming an excavation chamber below said seal; and (c) means for varying water pressure within said excavation chamber relative to seawater pressure, permitting development of a pressure differential inducing a downwardly directed force on said silo.

7. Apparatus as recited in claim 6, including buoyancy control means for said excavation module being selectively actuatable to render said excavation module buoyant, neutrally buoyant and nonbuoyant.

8. Apparatus as recited in claim 6, wherein said buoyancy control means of said excavation module is positionable for stabilization of said template, silo and excavation module assembly while buoyant and while submerged.

9. Apparatus as recited in claim 2, wherein said buoyancy controlling means comprises:

a plurality of horizontally disposed buoyancy tanks being secured to said template and being of a dimension rendering the assembly of said template, silo and excavation module buoyant with said silo in its raised position relative to said template.

10. Apparatus as recited in claim 1, wherein said excavation means comprises of water jetting means directing a plurality of water jets in an array for loosening soil from the seabed.

11. Apparatus as recited in claim 10 wherein said jetting means is rotatably movable to ensure sweeping of water jetting activity against the entire seabed surface exposed within said silo.

12. Apparatus as recited in claim 10 wherein water and soil outlet means is formed at the lower entremity of said silo, loosened soil from said seabed being entrained within water and discharged from said outlet means where the same flow upwardly along the exterior surface of said silo to the surface of the seabed.

13. A method for installation of an elongated tubular silo having a lower cutting shoe to a predetermined depth in the seabed comprising:

(a) establishing releasable assembly of a silo with a submergible silo installation template;

(b) causing said silo and template assembly to descend to the seabed at the intended installation site;

(c) lowering said silo relative to said template until said cutting shoe contacts the seabed;

(d) positioning a submergible excavation module at least partially within said silo and in excavating contact with seabed soil;

(e) energizing said excavation module for loosening said soil and conveying the soil from the seabed to a location externally of said silo;

(f) controllably lowering the silo into the seabed during soil excavation by said excavation module until the silo has reached its designed depth; and (g) recovering said excavation module from the silo for reuse and recovring said silo installation template for reuse, leaving the silo installed in the seabed.

14. The method of claim 13 including controllably applying hydrostatically induced downwardly directed resultant force on the silo during soil excavation for enhancement of silo penetration into the seabed soil.

15. The method of claim 14 wherein:

(a) said silo excavation module establishes a seal within said silo and defines an excavation chamber beneath said seal; and (b) means controllably establishes a reduces perssure condition within said excavation chamber in comparison with hydrostatic pressure at the water depth of said seal thus developing said downwardly directed resultant force.

16. The method of claim 13 wherein conveying of the loosened soil is accomplished by entraining the loosened soil in water and pumping the water and soil from the silo.

17. The method of claim 13 wherein loosening of the soil is accomplished by a rotary suction dredge supported and manipulated by said excavation module.

18. The method of claim 13 wherein loosening of the soil is accomplished by water jetting activity.

19. The method of claim 13 wherein conveying of the loosened soil is accomplished by entraining the soil in water and forcing the water and soil from the lowered portion of said silo resulting in its upward flow along the exterior surface of the silo to the surface of the seabed.

* * * * *

UNITED STATES PATENT OFFICE
CERTIFICATE OF CORRECTION

Patent No. 4,744,698 Dated May 17,1988

Inventor(s) David S. Dallimer, et al

It is certified that error appears in the above-identified patent and that said Letters Patent are hereby corrected as shown below:

IN THE BIBLIOGRAPHY:

After the filing date information, please insert:

--Foreign Application Priority Data September 10, 1986 [UK] United Kingdom.....86 21772--

In the first inventor's name, kindly delete "Davis" and insert instead --David--.

IN THE SPECIFICATION:

Column 1, line 14, kindly delete "nize" and insert instead --nimize--.

Column 1, line 36, kindly delete "possibilty" and insert instead --possibility--.

Column 2, line 33, kindly delete "excuation" and insert instead --excavation--.

Column 2, line 51, kindly delete "buoyance" and insert instead --buoyancy--.

Column 2, line 53, after "template", kindly delete the semicolon ";", and insert instead a dash -- - --.

Column 2, line 55, kindly delete "buoyaness" and insert instead --buoyancy--.

Column 3, line 23, kindly delete "is" and insert instead --this--.

Column 3, line 33, kindly delete "into junction" and insert instead --in conjunction--.

UNITED STATES PATENT OFFICE
CERTIFICATE OF CORRECTION

Patent No. 4,744,698 Dated May 17, 1988

Inventor(s) David S. Dallimer, et al

It is certified that error appears in the above-identified patent and that said Letters Patent are hereby corrected as shown below:

Column 3, line 45, kindly delete "a".

Column 4, line 2, kindly delete "7" and insert instead --8--.

Column 4, line 26, kindly delete "modules" and insert instead --module--.

Column 4, line 28, kindly delete "partically" and insert instead --partially--.

Column 4, line 43, kindly delete "Refering" and insert instead --Referring--.

Column 4, line 63, kindly delete "refered" and insert instead --referred--.

Column 5, line 16, kindly delete "resistence" and insert instead --resistance--.

Column 5, line 49, kindly delete "bulk" and insert instead --bulk- --.

Column 5, line 53, kindly delete "vacinity" and insert instead --vicinity--.

Column 5, line 55, kindly delete "vacinity" and insert instead --vicinity--.

Column 5, line 55, kindly delete "rotably" and insert instead --rotatably--.

Column 6, line 15, kindly delete "is" and insert instead --as--.

Column 6, line 43, kindly delete "tion domed bulkhead" and insert instead --tion. Domed bulkhead--.

CERTIFICATE OF CORRECTION

Patent No. 4,744,698 Dated May 17, 1988

Inventor(s) David S. Dallimer, et al

It is certified that error appears in the above-identified patent and that said Letters Patent are hereby corrected as shown below:

Column 6, line 48, kindly delete "vacinity" and insert instead --vicinity--.

Column 7, line 17, kindly delete "dition influence" and insert instead --ditions influence--.

Column 7, line 18, kindly delete "as".

Column 7, line 22, kindly delete "desend" and insert instead --descend--.

Column 7, line 26, after three, insert a comma --,--.

Column 7, line 29, kindly delete "restraing" and insert instead --restraining--.

Column 7, line 62, kindly delete "Refering" and insert instead --Referring--.

Column 8, line 1, kindly delete "then" and insert instead --than--.

Column 8, line 39, kindly delete "Refering" and insert instead --Referring--.

Column 8, line 45, kindly delete "tionship" and insert instead --tionships--.

Column 9, line 15, kindly delete "Refering" and insert instead --Referring--.

Column 9, line 22, kindly delete "born" and insert instead --borne--.

Column 9, line 28, kindly delete "Refering" and insert instead --Referring--.

CERTIFICATE OF CORRECTION

Patent No. 4,744,698 Dated May 17, 1988

Inventor(s) David S. Dallimer, et al

It is certified that error appears in the above-identified patent and that said Letters Patent are hereby corrected as shown below:

Column 9, line 48, kindly delete "umbilicles" and insert instead --umbilicals--.

Column 9, line 50, after "adjustment", kindly insert --of--.

Column 9, line 52, kindly delete "umbilicles" and insert instead --umbilicals--.

Column 10, line 1, kindly delete "extration" and insert instead --extraction--.

Column 10, line 4, after "the" (first occurrence), kindly insert --template--.

Column 10, line 4, kindly delete "assend" and insert instead --ascends--.

Column 10, line 12, kindly delete "days" and insert instead --day's--.

Column 10, line 25, kindly insert a comma "," after "repair".

Column 10, line 58, kindly delete "interperted" and insert instead --interpreted--.

UNITED STATES PATENT OFFICE
CERTIFICATE OF CORRECTION

Patent No. 4,744,698 Dated May 17, 1988

Inventor(s) David S. Dallimer, et al

It is certified that error appears in the above-identified patent and that said Letters Patent are hereby corrected as shown below:

IN THE CLAIMS:

Claim 1, line 12, kindly delete the period "." and insert instead a semicolon --;--.

Column 3, line 5, kindly delete the colon ":" and insert instead a semicolon --;--.

Claim 12, line 2, kindly delete "is", and insert instead --are--.

Claim 12, line 2, kindly delete "entremity" and insert instead --extremity--.

Claim 13, line 20, kindly delete "recovring" and insert instead --recovering--.

Column 15, line 5, kindly delete "establishes" and insert instead --establishing--.

Claim 15, line 5, kindly delete "reduces perssure" and insert instead --reduced pressure--.

Signed and Sealed this

Twenty-fifth Day of April, 1989

*Attest:*

*Attesting Officer*

DONALD J. QUIGG

*Commissioner of Patents and Trademarks*